US005246085A

United States Patent [19]

Liegel et al.

[11] Patent Number: 5,246,085

[45] Date of Patent: Sep. 21, 1993

[54] PORTABLE WORK STATION

[75] Inventors: Reinald D. Liegel; James Ballard; Charles E. Naber; James C. Graham, all of Waukesha; Craig A. Wisner, Wauwatosa, all of Wis.

[73] Assignee: Hein-Werner Corporation, Waukesha, Wis.

[21] Appl. No.: 896,394

[22] Filed: Jun. 10, 1992

[51] Int. Cl.[5] ..... E04G 1/00

[52] U.S. Cl. ..... 182/118; 182/153; 182/223; 182/113; 182/129

[58] Field of Search ..... 187/117, 116, 118, 152, 187/153, 223, 113, 129, 27, 119; 248/439

[56] References Cited

U.S. PATENT DOCUMENTS

| | | | |
|---|---|---|---|
| 91,039 | 6/1869 | Phillips | 182/27 X |
| 234,653 | 11/1880 | Brackett et al. | 248/439 |
| 1,912,947 | 6/1933 | Martin | 182/152 |
| 1,943,871 | 1/1934 | Landberg | 182/152 |
| 2,261,831 | 11/1941 | Farr et al. | 182/223 |
| 3,851,729 | 12/1974 | Gordon . | |
| 3,997,024 | 12/1976 | Fredricks . | |
| 4,004,652 | 1/1977 | Laboy-Alvarado | 182/118 |
| 4,016,955 | 4/1977 | Gates . | |
| 4,690,248 | 9/1987 | Kileen | 182/118 |
| 4,807,719 | 2/1989 | Burkstrand et al. . | |
| 4,825,976 | 5/1989 | Wyse . | |
| 4,941,547 | 7/1990 | Livick . | |
| 4,947,962 | 8/1990 | Helsper . | |

FOREIGN PATENT DOCUMENTS

| | | | |
|---|---|---|---|
| 447 | 1/1909 | United Kingdom | 182/27 |

*Primary Examiner*—Alvin C. Chin-Shue
*Attorney, Agent, or Firm*—James A. Wilke

[57] ABSTRACT

A portable work station suitable for use in a vehicle spray paint booth, the station includes a platform member supported on each end by an open frame end support member. The end members pivot about the end of the platform and can be adjusted so as to change the height of the platform above the work surface. A leg of each end support member is wedged between pin, a stop stud fixed to the end of the platform and a locking pin is pivoted into engagement with the leg to prevent walking motion of the work station while in use. The work station can be provided with a railing along the platform edge, a tool hanger, and can be provided with an air supply stanchion to facilitate the spray paint operation.

10 Claims, 4 Drawing Sheets

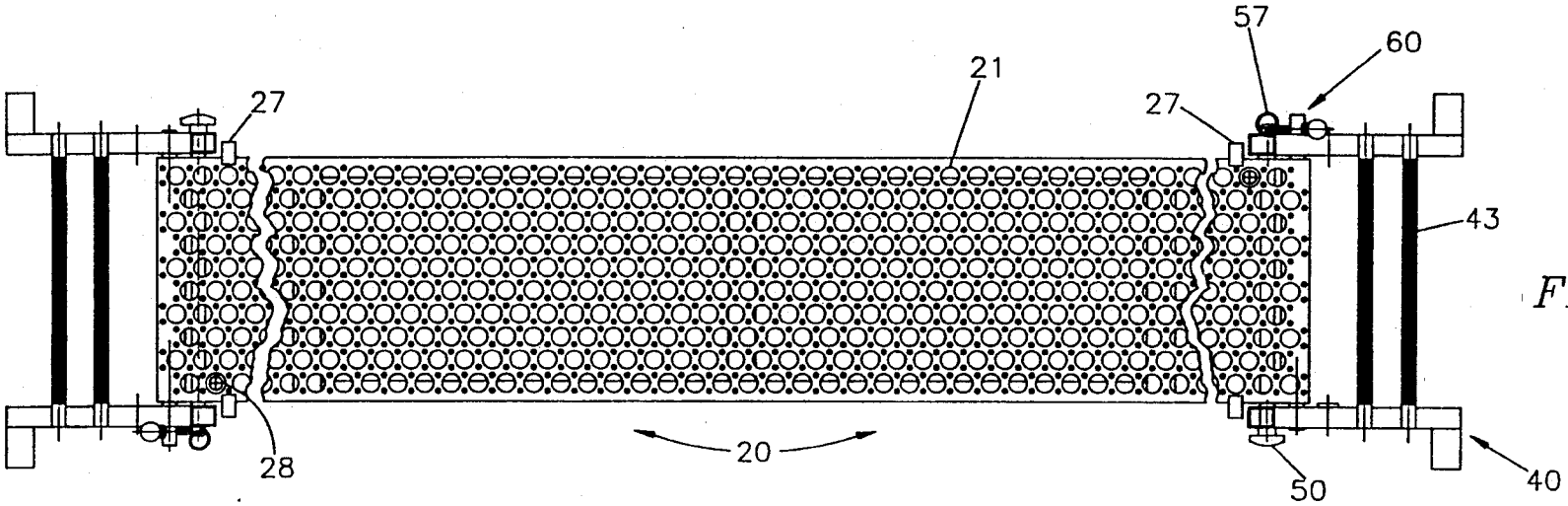
FIG 1
40
43
60
57
27
50
21
20
27
28
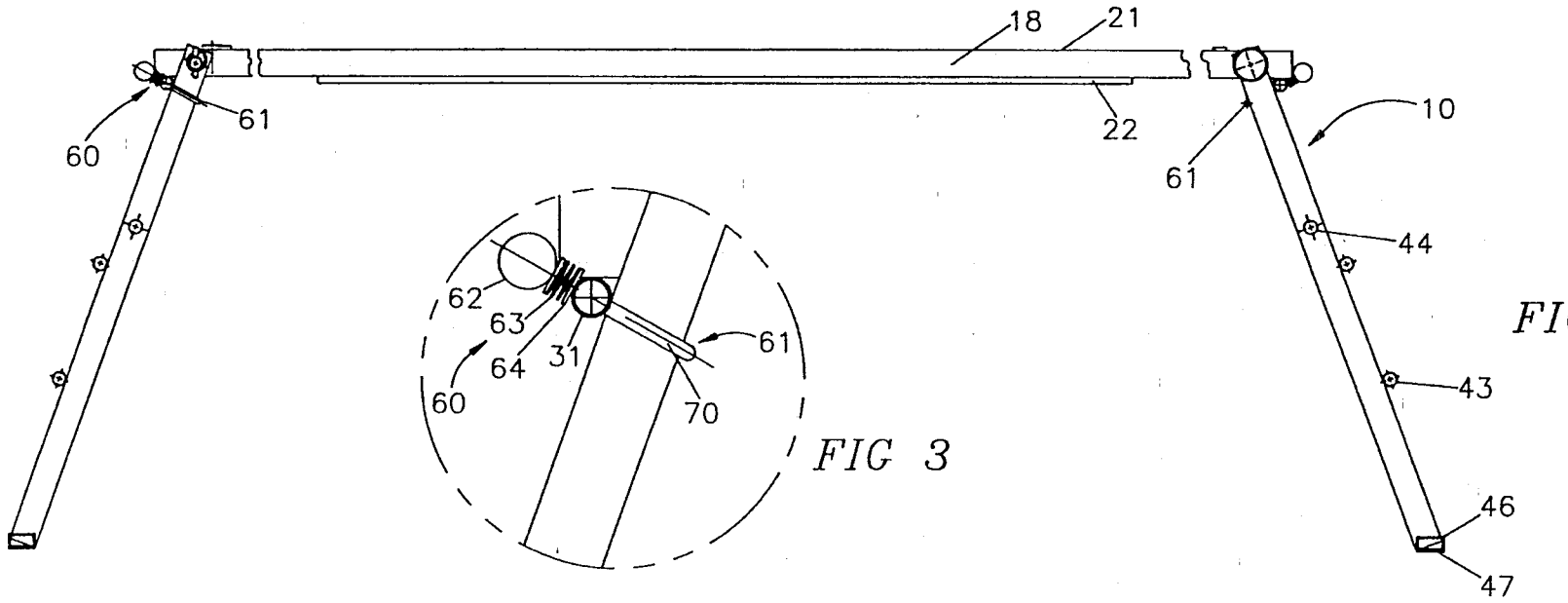
FIG 2
10
44
43
46
47
61
21
22
18
61
60
FIG 3
61
70
31
63
64
62
60

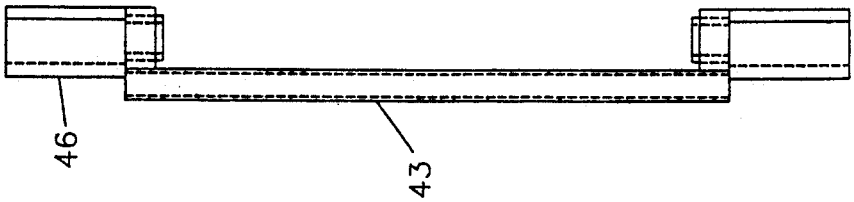
FIG 8
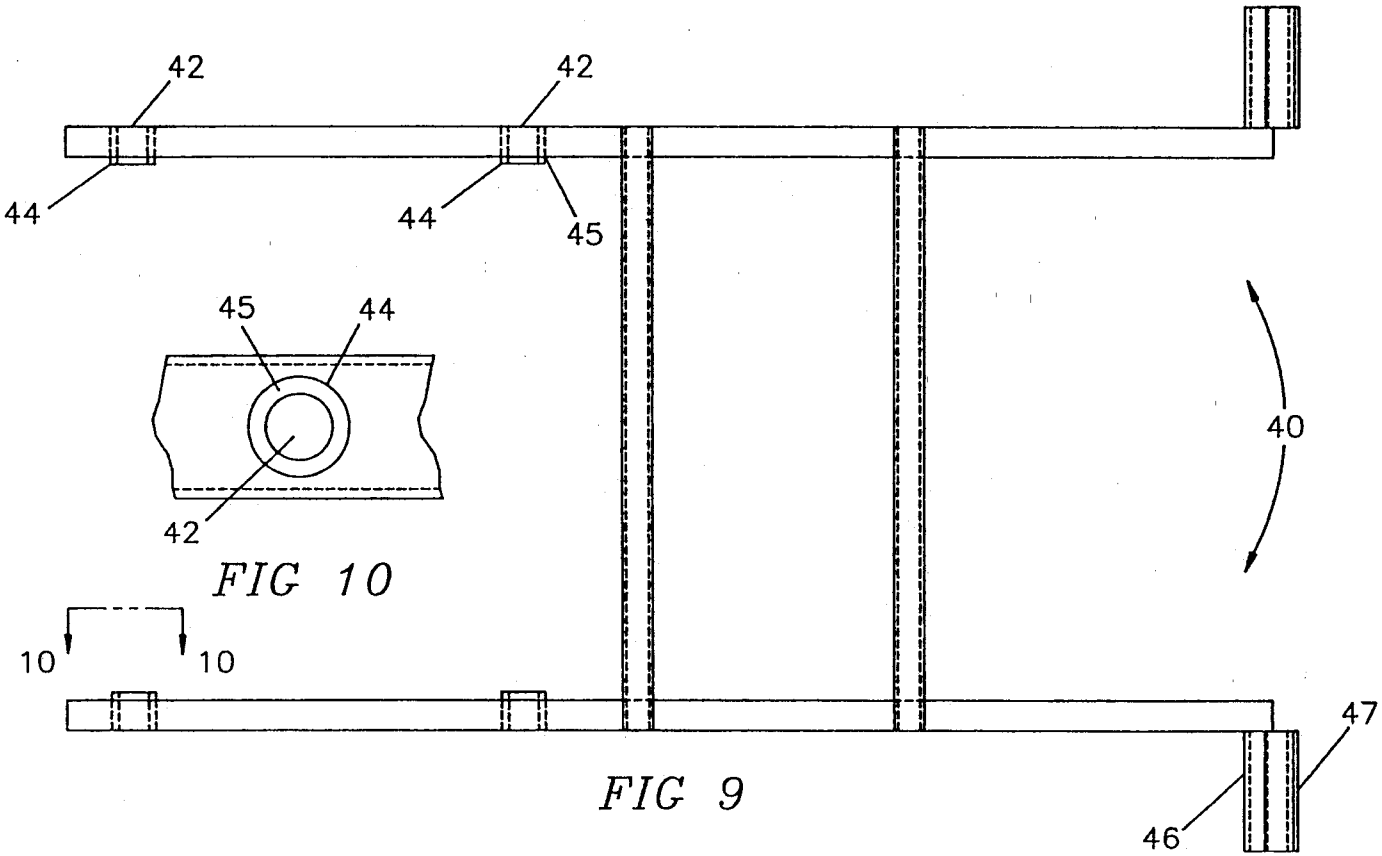
FIG 9
FIG 10
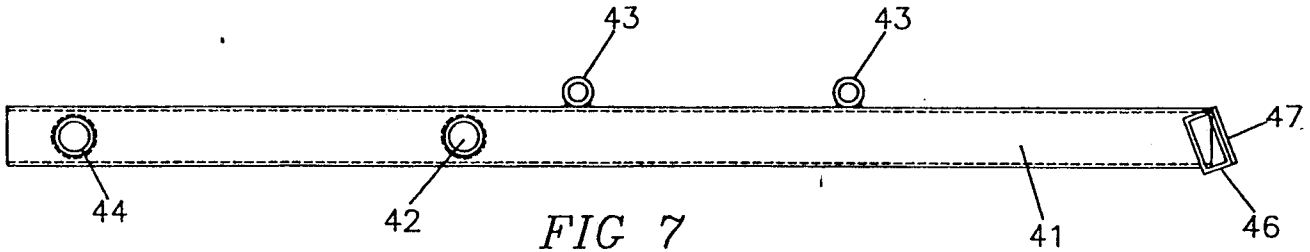
FIG 7

PORTABLE WORK STATION

BACKGROUND OF THE INVENTION

1. Field of the Invention

The present invention relates to work stations and more particularly to portable, foldable work stations used in an autobody repair shop and primarily in a vehicle paint booth.

2. Description of Prior Art

Scaffolding, generally, can be divided into two general groups, i.e.; free standing or attached. In either case, the scaffolding provides a work station platform upon which a worker can perform some type of activity. Usually the scaffolding is attached to the structure being worked on or positioned immediately adjacent to a work piece. Examples of such types of scaffolds are shown in U.S. Pat. Nos. 4,947,962, 4,941,547, 4,825,976 and 3,851,729.

In the application of a scaffold work station for use in a vehicle paint booth, several additional considerations must be dealt with such as portability and air flow. During a painting operation in a vehicle spray booth, the operator must travel the length of the vehicle being painted in a smooth, generally uninterrupted manner. The operator must also avoid the tangling of air hoses that would impede his motion. Failure to do so may result in lap-lines, color variation, paint runs, etc. In addition exposure of the painted surface of the vehicle must be maintained in a contamination free environment, thus paint booths have a directed air flow system that must be generally unimpeded. The work station must be movable within the spray booth during a painting session but movement in and out of the booth during a painting session is not desirable since that would introduce contamination into the booth. The paint booth operator must also be able to reach various elevations in order to paint vehicles ranging from passenger automobiles to mini-vans to tractor trailers and the like. In addition to painting the vehicle proper, an operator must also so work on components of the vehicle, such as doors, hood, bumper, etc. as well as prepatory work on the vehicle, known as "pre-trimming" in the industry. Existing scaffold work stations do not provide or facilitate such pre-trimming procedures.

U.S. Pat. No. 3,997,024 discloses a portable scaffold ladder that may solve some of the vehicle paint booth scaffolding problems but the scaffold would have to be moved outside the paint booth to be able to access both sides of the vehicle to be painted. Although U.S. Pat. No. 4,807,719 generally discloses an apparatus to ascend a scaffold, it does disclose a scaffold similar to the U.S. Pat. No. 3,997,024 patented device but with the same problem of requiring moving the apparatus outside of a vehicle spray booth.

SUMMARY OF THE INVENTION

According to the present invention, an improved portable work station is provided that is lightweight, portable, collapsible and height adjustable. When the present invention is in a fully collapsed position, the device is in a stored position flat on the floor surface of the paint booth, thereby allowing a spray booth operator to walk on the scaffolding without impeding access to the vehicle's underside. With the present invention being made out material, the entire apparatus can be lifted over the vehicle in the spray booth to position it on one side of the vehicle or the other without moving the scaffold work station outside of the spray booth. The use of non-ferrous metal or composite material not only provides lightweight capability but also eliminates electrical sparking in the spray paint environment.

A primary objective of the present invention is to provide a portable, foldable scaffold work station adaptable for use at various heights above a work surface, from flat on such surface to several intermediate heights above such surface. The leg assembly of the work station being foldable under the platform member, in the stored position, to minimize the length of the work station and to avoid clearance problems with the vehicle.

Another primary objective of the present invention is to provide a lightweight scaffold work station that can be moved from one side of a vehicle being worked on to the other side of that vehicle without removing the work station from the spray booth.

Another primary objective is to lock the legs of the end supports to the work platform, at selected heights, with a locking rod that engages the leg as the rod is turned toward the leg thereby wedging the leg in a locked position that eliminates any play between the leg member and the work platform.

Another important objective of the present invention is to provide the least amount of impediment to the flow of air in a paint spray booth.

Another objective of the present invention is to provide a platform adapted to receive a tool hanger assembly suitable for holding or supporting tools or components of a vehicle being painted in said paint booth. An advantage of the tool hanger assembly is to allow the vehicle component to be orientated on the work platform in the same manner as that component will be viewed when the component is installed on the vehicle.

Another objective of the invention is to provide a scaffold work station with a platform having a skid resistant surface on which an operator can move from one end of a vehicle to the other end during a spray paint operation without stopping, to aid that movement by providing a facility for an air supply for the operator's spray paint equipment while the operator is moving back and forth on such work station.

Other principal features and advantages of the invention will become apparent to those skilled in the art upon review of the following drawings, the detailed description and the appended claims.

BRIEF DESCRIPTION OF THE DRAWINGS

FIG. 1 is a top plan view of the scaffold work station according to this invention with the leg assemblies fully extended;

FIG. 2 is a side elevation view of this scaffold work station shown in FIG. 1;

FIG. 3 is a detail view of the leg locking rod assembly;

FIG. 7 is a side elevation view of one of the end support assemblies;

FIG. 8 is a end view of the end support assembly of FIG. 7;

FIG. 9 is a plan top view of the end support assemblies;

FIG. 10 is a side view of a typical bushing installed in one leg assembly of FIG. 7;

Figure 6:
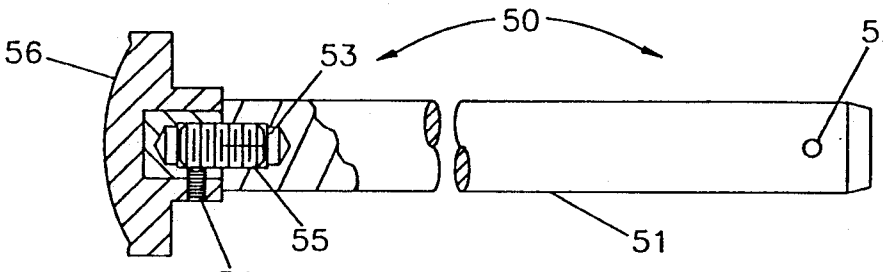
FIG. 6 is a plan view of leg pin assembly.

Before explaining the preferred embodiment of the invention in detail it is to be understood that the invention is not limited in its application to the details of construction and the arrangement of the components set forth in the following description as illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF A PREFERRED EMBODIMENT

The work station (10) as shown in FIGS. 1 and 2 generally includes a platform assembly (20) having a support assembly (40) mounted on each end. Each support assembly (40) is pivotally attached to the platform assembly by means of a pivot pin (50) and locked in position by means of a lock pin assembly (60).

PLATFORM ASSEMBLY

Figure 5:
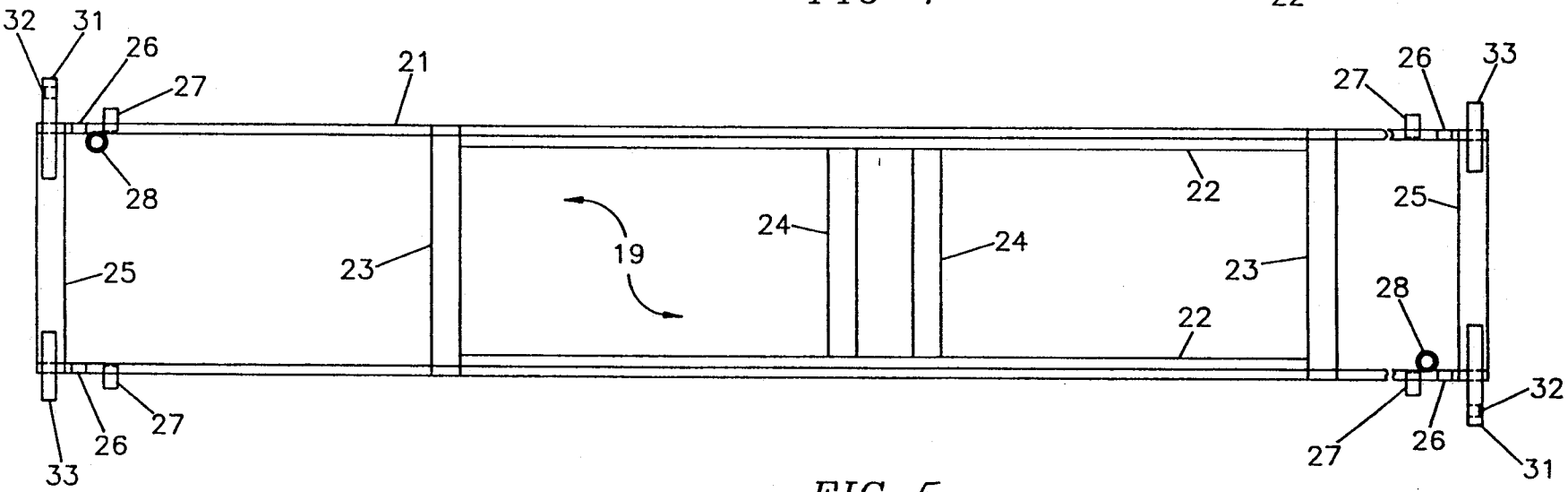
FIG. 5 is a bottom view of the platform frame assembly.

The platform assembly (20) comprises an open grip grating channel (21) having sides (18) reinforced by an open frame assembly (19) fixed to the interior of the grating channel (21). The open frame assembly (19) (See FIG. 5) includes two side supports (22), two transverse supports (23) and two center supports (24) with the side supports (22) and the transverse supports (23) forming a substantially rectangular shaped open frame. The center supports (24) are secured to the side supports (22) in a spaced relation to each other between the transverse supports (23). The open frame assembly (19) is fixed to the grating channel (21) by any suitable means such as welding or bolts. The supports 22, 23 and 24 have a tubular or angular shaped cross section.

Each end of the platform assembly (20) is provided with an end member (25) fixed to the interior of the grating channel so that the ends of the grating channel and one surface of the end member (25) are co-planer. The end members (25) are formed of the same cross section as the open frame assembly supports and welded or bolted to the grating channel.

Figure 4:
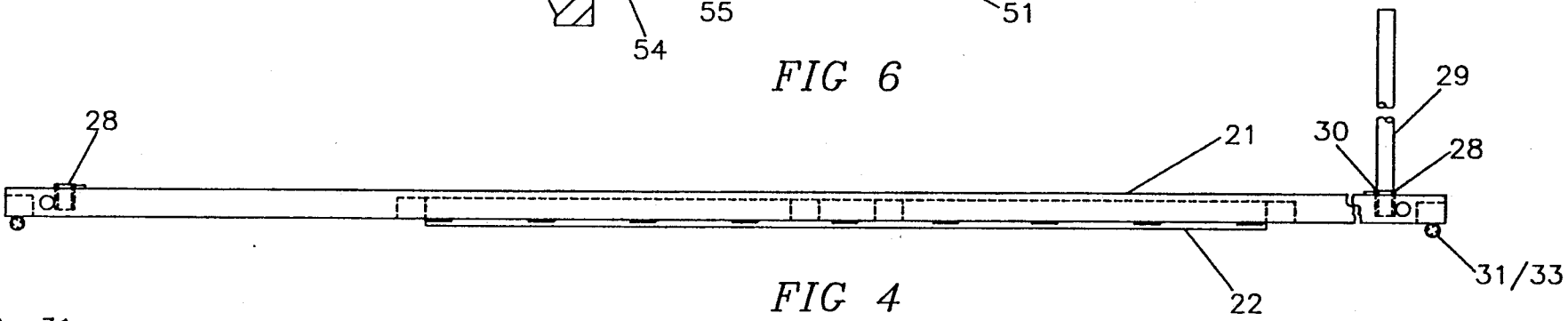
FIG. 4 is a side elevation view of the platform frame assembly, with stanchion.

The sides (18) of the grating channel (21) (See FIGS. 4 & 5) are provided with two pairs of through holes (26), one pair at each end of the platform assembly and located between the end members (25) and the interior transverse support (24). Each pair of holes (26) are aligned co-axially and adapted to receive a leg pin (50). Fixed to each side (18) of the platform assembly is a plurality of stop studs (27) extending in a perpendicular relation to the sides of the grating channel.

Mounted to the grating channel (21), perpendicular to the grating channel's upper surface, is a plurality of stanchion bushings (28) adapted to receive a stanchion (29). (See FIG. 4) The stanchion is removably attached to the platform member assembly and is adapted to be connected to an air supply (not shown) by conventional means well known in the art.

Fixed to each end of the platform assembly is a leg lock/stop (31) having a through bore (32). The through bore (32) is orientated at an angle offset from a perpendicular by less than Ninety degrees and adapted to receive a locking rod (60). Fixed to the platform assembly opposite and co-axially with the leg lock/stop (31) is a leg stop (33). The leg stop (33) and the leg lock/stop (31) can be of any suitable cross section but the preferred embodiment utilizes a circular cross section.

The platform assembly of the present invention can be constructed of any suitable non-ferrous material but the preferred embodiment utilizes aluminum in keeping with the present invention objectives of providing a light and strong work station.

END SUPPORT LEG ASSEMBLY

The portable work station (10) is provided with two end support leg assemblies (40) with each end support leg assembly including a pair of legs (41) (See FIGS. 7, 8, 9 and 10). The legs (41) are maintained in a spaced apart relation by at least two transverse rung members (43) fixed to the legs so that the legs (41) and rungs (43) form an open frame rectangular framework. Each leg (41) has a plurality of adjustment bores (42) adapted to receive a leg bushing (44) in each bore. The leg bushings (44) are fixed to the leg by welding the bushing's shoulder (45) to the leg. The bushings are located in the legs such that each bushing in one leg aligns co-axially with a bushing in the other leg forming the end support leg assembly.

Fixed to each leg, at the end of the leg opposite the leg bushing, is a foot (46). The foot extends, at a right angle, from the leg and has a foot pad (47) formed of a material, such as closed cell foam, to inhibit movement of the leg and facilitate stability of the work station.

LEG PIN ASSEMBLY

A end support leg assembly (40) is attached to each end of the platform assembly (20) by a leg pin assembly (50). (See FIG. 6) The leg pin assembly (50) comprises a leg pin (51) having a bore (52) on one end and a tapped end bore (53) on its other end. A hand wheel (56) is attached to the leg pin by a first set screw (55) threaded into the end bore (52) and the hand wheel (56). The hand wheel is fixed to said first set screw by a second set screw (54) threaded at a right angle to the first set screw.

The holes (42) through the leg bushing (44) are aligned with the holes (26) in the side of grating channel (21) such that the four holes are co-axial. The leg pin assembly (50) is inserted into the four holes until the bore (52) in the leg pin exits the leg bushing opposite the leg bushing initially receiving the leg pin. The leg pin assembly (50) is removably fixed in place by a retaining pin (57) inserted into the bore (52) through the leg pin (51).

In operation, each leg assembly (40) is free to pivot about the leg pin assembly (50). The leg assembly (40) is pivoted into the platform member assembly (20) for storage in the underside of the platform assembly. In such folded stored position the work station (10) can be laid on the floor surface of the paint booth. To raise the platform assembly above the paint booth floor surface, the leg assembly (40) on each end of the platform assembly is pivoted away from the underside of the platform assembly until the legs (41) of each leg assembly (40) abuts the leg stop (33).

The leg assembly (40) is locked into position by a lock assembly (60) that engages the leg (41). (See FIG. 3) In this embodiment the lock assembly includes an L-shaped steel rod (61) having a long arm (70) and a short arm (72). The long arm (70) is aligned in the bore (32) in the leg lock/stop (31). The long arm (70) is maintained in bore (32) by a flat washer (64) mounted on the end of the arm and a hook spring (63) co-axially mounted on the end of the long arm (70) between the leg lock/stop and a knob (62) fixed to the end of the long arm (70). In operation the rod (61) is free to pivot the short arm (72) around the axis of the long arm (70) and pushed toward the leg lock/stop along the long portion axis thereby causing the distal end of the short portion of the locking rod to trace an arc intersecting a plane formed by a side of the leg opposite the side of the leg contacting the leg lock/stop whereby wedging the leg in a locked position between the leg lock/stop and the short portion (72) of the locking rod (61).

An alternative embodiment for the means for pivotally connecting the end support member (40) to the platform member (20) is a rotable hinge (not shown) that fixes one end of each leg member (41) to the platform member (20) thereby allowing the end support member (40) to pivot about the end of the platform assembly at selected positions between a storage position and a support position.

An alternative embodiment of the present invention (not shown) provides a locking arm, having a plurality of notches, pivotally attached to each end of said platform member (20) between the end support (25) and the interior transverse support (23). To adjust the height of the work station between a storage position and a support position, the locking arm is pivoted to a position that allows one of the notches in the locking arm to engage one of the leg assembly (40) rungs (43) thereby selectively locking the work station in a selected position.

The work station may also be provided with a removable hand railing member (not shown) adapted to be attached to the grating channel by means well known in the art. The work station may be provided with a non-skid surface on the upper surface of the grating channel.

TOOL HANGER ASSEMBLY

Figure 12:
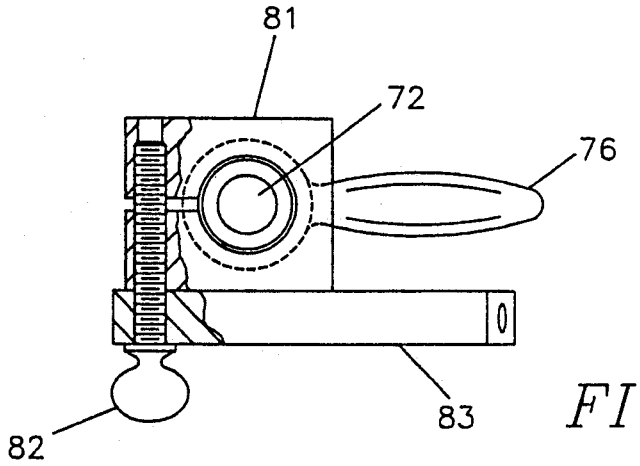
FIG. 12 is a top view of the tool support assembly shown in FIG. 11.
Figure 11:
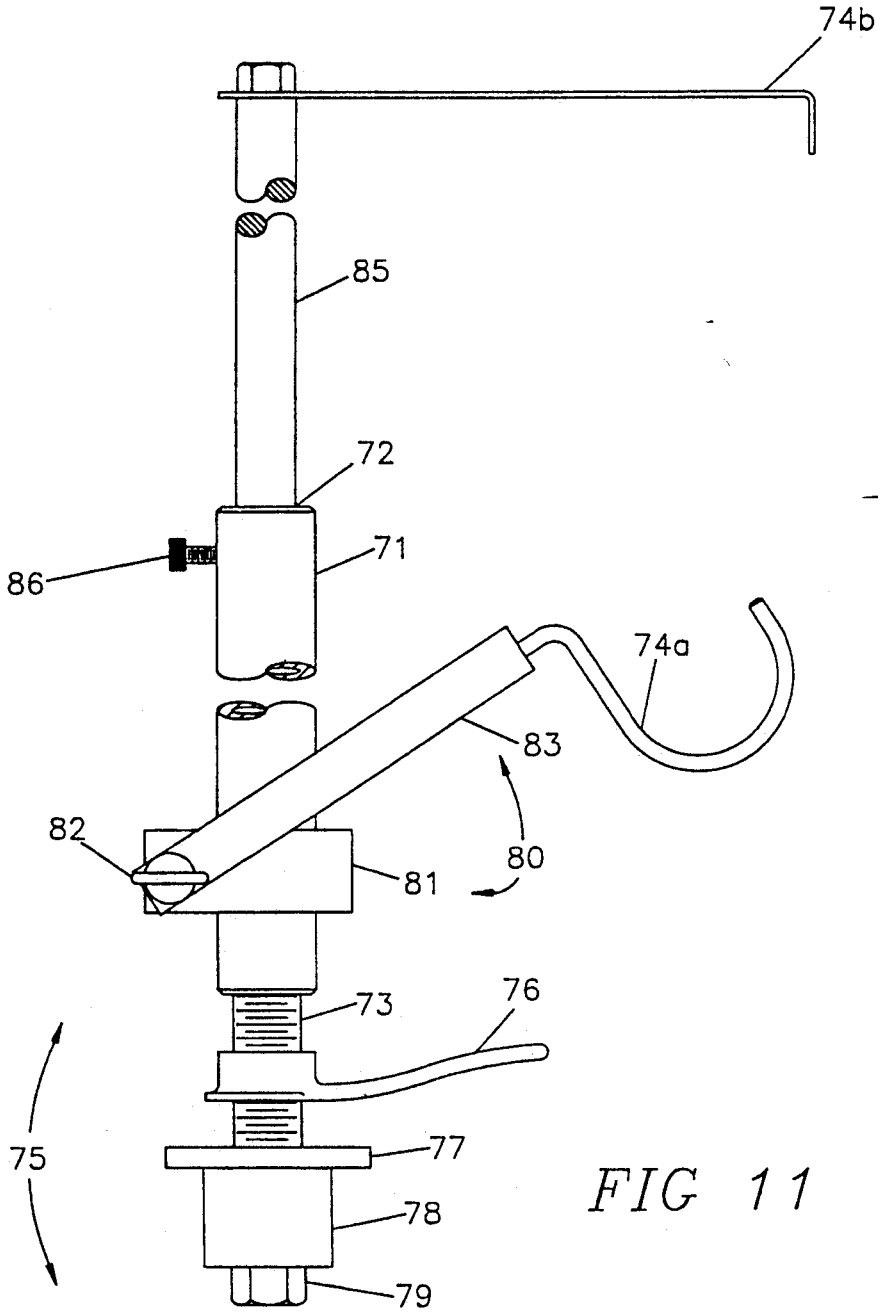
FIG. 11 is a plan side elevation view of a tool support assembly.

The tool hanger assembly (70) shown in FIGS. 11 and 12 includes a hanger tube (71), a means for hanging tools (80) and a means for securing (75) the hanger tube to the platform assembly (20). The hanger tube (71) has two ends, one end having an end bore (72) and the second end being threaded externally (73). The end bore (72) is adapted to receive a tool hook (74*a*) of any suitable type well known in the art or the end bore (72) may receive a co-axial telescoping tube (85), selectively adjustable within the hanger tube (71) and secured within said hanger tube (71) by a tube set screw (86). The telescoping tube (85) is adapted to receive a tool hook (74*a*) or tool hook (74*b*) of any suitable type well known in the art. The threaded end of the hanger tube is adapted to engage any hole in the open grip grating channel (21) and secured thereto by a means, including in combination, a handle nut (76), washer (77), rubber plug (78) and end nut (79) co-axially mounted to the threaded end (73) of the hanger tube. The means to secure the hanger tube (75) is operated by turning the handle nut (76) thereby apply downward pressure to the washer (77) which pulls the end nut (79) up against the rubber plug (78). As said pressure increases the rubber plug (78) is compressed causing it to bulge thereby engaging the inside diameter of the hole in the grip grating channel (21) and securing the tool hanger assembly (70) to the platform assembly (20).

The hanger tube (71) of the tool hanger assembly (70) is of a suitable length and adapted to receive at least one means for hanging tools (80). The means for hanging tools includes a clamp (81) having a through bore sized to slidably engage the hanger tube (71). The clamp is selectively fixed to the hanger tube (71) by a thumb screw (82) threaded into said clamp. Said thumb screw also pivotally secures a tool hook bar (83) to the clamp (81), which tool hook bar is adapted to receive a tool hook (74) of any suitable type well known in the art.

In operation, the tool hanger assembly (71), or a number of them, is mounted in any of several holes in the grip grating channel (21) convenient for an operator of the work station (10). The operator of the work station may mount several of said tool hanging clamps (81) to the hanger tube (71), at convenient heights along the hanger tube and install an appropriate tool hook (74) suitable for holding a work piece or tool upon which the operator will work. One such operation is to hang various vehicle components (such as doors, hood, bumper, etc.) to be painted in the paint booth at a height or at an orientation such component has in use on said vehicle. The advantage in performing the painting operation with the vehicle component so orientated, is that the paint booth operator performs his work on the said component such that the component will be painted as viewed when the component is installed on the vehicle.

Thus, it should be apparent that there has been provided in accordance with the present invention a portable work station that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. A portable work station with a tool hanger assembly mounted on the work station, said work station comprising:

a pair of end support members, each end support members, including a pair of spaced-apart leg members maintained in spaced apart relationship by a plurality of transverse step members fixed to said leg members, each leg member having a plurality of adjustment bores proximate to one end of each leg member, a platform member supported by said end support members, means for pivotally connecting said end support members to each end of said platform member for pivotal movement between a storage position within said platform and an open position supporting said platform, means for locking said platform member to said end support member, a tool hanger assembly mounted on said platform member, wherein the tool hanger assembly comprising:

a hanger tube having on one end an end bore adapted to receive a tool hook and a threaded portion on a second end opposite the end bore end, means for securing the hanger tube to the work station including in combination a handle nut, washer, rubber plug and end nut, co-axially engaging the threaded end of the hanger tube, and means for hanging tools adapted to be slidably mounted on the hanger tube including a clamp having a through bore sized to engage the hanger tube and selectively fixed to said hanger tube by a thumb screw threaded into said clamp, which thumb screw further engages and pivotally secures a tool hook receiving tool hook bar to said clamp.

2. The work station of claim 1 wherein said locking means comprises a locking arm pivotally attached to each end of said platform member, said locking arm includes a plurality of notches for engaging one of the step members at selectable positions.

3. The work station according to claim 1 wherein the hanger tube is further adapted to receive and fix a co-axial telescoping tube, adapted to receive a tool hook, selectively adjustable within said hanger tube.

4. The work station of claim 1 wherein the platform member is adapted to receive an air supply stanchion, pivotally attached to said platform member.

5. A portable work station with a stop stud mounted on each end of said work station, comprising:

a pair of end support members, each end support member including a pair of spaced-apart leg members maintained in spaced apart relationship by a plurality of transverse step members fixed to said leg members, each leg member having a plurality of adjustment bores proximate to one end of each leg member, a platform member supported by said end support members, means for pivotally connecting said end support members to each end of said platform member for pivotal movement between a storage position within said platform and an open position supporting said platform, means for locking said platform member to said end support members, and a stop stud mounted on each end of said platform member perpendicular to a side of the platform member and having a length sufficient to contact and brace each leg member of each end support member against said stop stud, each said stop stud being further provided with a through bore and an L-shaped locking pin mounted in said bore adapted to engage at least one leg member of said end support member.

6. The work station according to claim 5 wherein said means for pivotally connecting the end support member to each end of said platform member comprises a selectably, rotable hinge that fixes one end of each leg member to the platform member.

7. A portable work station comprising:

a platform, a pair of end members, means for pivotally connecting one of said end members to each end of said platform, said end members being pivotally movable between a storage position in said platform and a support position at each end of said platform, a stop stud, including a bore at the end of said stud, mounted on each end of said platform to hold said end members in the support position and means mounted on each of said stop studs for locking said end members in the support position, each of said locking means comprises an L-shaped rod having a long portion and a short portion, said long portion of said L-shaped rod being pivotally mounted in said bore and said short portion being rotatable into engagement with said end member to prevent vibration of said end member.

8. A portable workstation comprising:

a platform, a pair of end members, means for pivotally connecting one of said end members to each end of said platform, said end members being pivotally movable between a storage position in said platform and a support position at each end of said platform, a stop stud mounted on each end of said platform to hold said end members in the support position and means mounted on each of said stop studs for locking said end members in the support position, and a tool hanger assembly mounted on said platform, wherein the tool hanger assembly comprises:

a hanger tube having on one end an end bore adapted to receive a tool hook and a threaded portion on a second end opposite the end bore end, means for securing the hanger tube to the work station including in combination a handle nut, washer, rubber plug and end nut, co-axially engaging the threaded end of the hanger tube, and means for hanging tools adapted to be slidably mounted on the hanger tube including a clamp having a through bore sized to engage the hanger tube and selectively fixed to said hanger tube by a thumb screw threaded into said clamp, which thumb screw further engages and pivotally secures a tool hook receiving tool hook bar to said clamp.

9. The work station according to claim 8 wherein the hanger tube is further adapted to receive and fix a co-axial telescoping tube, adapted to receive a tool hook, selectively adjustable within said hanger tube.

10. A portable workstation comprising:

a pair of end support members, each end support member including a pair of spaced-apart leg members maintained in spaced apart relationship by a plurality of transverse step members fixed to said leg members, each leg member having a plurality of adjustment bores proximate to one end of each leg member, a platform member supported by said end support members, means for pivotally connecting said end support members to each end of said platform member for pivotal movement between a storage position within said platform and an open position supporting said platform, a stop stud mounted on each end of said platform member, said stop stud having a bore, and means for locking said platform member to said end support members, said means for locking comprises a rod having a long portion and a short portion, said portions forming a right angle, one of said portions being slidably mounted in said bore in said stop stud, said bore being offset from a perpendicular by an angle less than ninety degrees, through a stop stud provided on the end of the platform member with the long portion of the rod held in a stored position by a handle mounted on the end of said long portion of said rod, and a compression spring coaxially mounted around said long portion of the rod between said stop stud and said handle whereby said short portion of said rod engages the leg member of the end support member as the rod is pivoted around its long portion axis and pushed toward the stop stud along the long portion axis thereby causing the distal end of the short portion of the rod to trace an arc intersecting the plane formed by a side of the leg member opposite the side of the leg member contacting the stop stud thereby wedging the leg member in a locked position between the stop stud and the short portion of said rod.

* * * * *